US009272563B2

(12) United States Patent
Glass et al.

(10) Patent No.: US 9,272,563 B2
(45) Date of Patent: Mar. 1, 2016

(54) SLIDING PANEL BOX GIFT CARD HOLDER

(75) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 13/294,063

(22) Filed: Nov. 10, 2011

(65) Prior Publication Data

US 2012/0285967 A1 Nov. 15, 2012

Related U.S. Application Data

(60) Provisional application No. 61/412,305, filed on Nov. 10, 2010.

(51) Int. Cl.

| | |
|---|---|
| ***B65D 43/12*** | (2006.01) |
| ***B42D 15/04*** | (2006.01) |
| ***B42D 15/02*** | (2006.01) |
| *B65D 43/20* | (2006.01) |
| *B42D 25/20* | (2014.01) |

(52) U.S. Cl.

CPC ..... *B42D 15/047* (2013.01); *B42D 15/027* (2013.01); *B42D 25/285* (2014.10); *B65D 43/20* (2013.01)

(58) Field of Classification Search

CPC .... B42D 15/047; B42D 25/285; B65D 43/20; B65D 43/14; B65D 77/286; B65D 5/4204; B65D 5/4241; B65D 5/4237

USPC ..... 220/345.1, 521, 522, 811–813; 229/124, 160.2, 162.1, 162.3, 5.84, 229/125.12–125.125; 206/774, 769, 772, 206/770, 575, 775, 231, 232

See application file for complete search history.

(56) References Cited

U.S. PATENT DOCUMENTS

| | | | | | |
|---|---|---|---|---|---|
| 639,679 | A | | 12/1899 | Kaufmann | |
| 1,544,463 | A | * | 6/1925 | Lengsfield | 206/459.5 |
| 1,568,982 | A | * | 1/1926 | Lengsfield | 40/312 |
| 1,860,586 | A | * | 5/1932 | McIlhenney | 206/772 |
| 2,058,608 | A | * | 10/1936 | Maeda | 217/62 |
| 2,884,724 | A | | 5/1959 | Lohnes et al. | |
| 3,199,238 | A | | 8/1965 | Brown | |
| 3,380,575 | A | * | 4/1968 | Hennessey | 206/45.25 |
| 3,755,925 | A | * | 9/1973 | Court | 434/299 |
| 3,848,348 | A | | 11/1974 | Hawley | |
| 4,697,364 | A | | 10/1987 | Dean | |
| 5,277,307 | A | * | 1/1994 | Kelly | 206/772 |
| 5,289,917 | A | * | 3/1994 | Chabria | 206/232 |
| 5,400,914 | A | * | 3/1995 | Lin | 220/345.4 |
| 5,497,876 | A | * | 3/1996 | Fleming | 206/232 |
| 5,575,384 | A | * | 11/1996 | Saye | 206/232 |

(Continued)

FOREIGN PATENT DOCUMENTS

| | | |
|---|---|---|
| CA | 2447733 | 3/2012 |
| WO | 2008020883 | 10/2008 |

*Primary Examiner* — Anthony Stashick
*Assistant Examiner* — James Way
(74) *Attorney, Agent, or Firm* — Polsinelli PC

(57) ABSTRACT

A gift card holder includes a two-leaf sliding panel mounted within a box that frames an image or object. In a first position, the panel covers the image or object within the box. In a second position, when the panel is partially drawn upward, the interior of the box is revealed. In a third position, when the panel is drawn completely upward, the two leaves of the panel open to reveal a gift card secured between the leaves.

11 Claims, 4 Drawing Sheets

(56) References Cited

U.S. PATENT DOCUMENTS

| | | | | |
|---|---|---|---|---|
| 6,418,648 | B1 | 7/2002 | Hollingsworth et al. | |
| 6,527,111 | B2 * | 3/2003 | Leung et al. | 206/232 |
| 6,732,459 | B1 | 5/2004 | Clark | |
| 6,877,263 | B2 | 4/2005 | Clark | |
| 7,056,122 | B2 | 6/2006 | Lockett | |
| D532,452 | S | 11/2006 | Heng et al. | |
| 7,275,683 | B2 * | 10/2007 | Lazarowicz et al. | 235/375 |
| D619,359 | S | 7/2010 | Pascua et al. | |
| 7,882,651 | B2 | 2/2011 | Wilen | |
| 2005/0284927 | A1 | 12/2005 | Wilen | |
| 2006/0101678 | A1 | 5/2006 | Wilen | |
| 2006/0231609 | A1 | 10/2006 | Lazarowicz et al. | |
| 2007/0094901 | A1 * | 5/2007 | Kibbe et al. | 40/124.06 |
| 2009/0217559 | A1 | 9/2009 | Sayre | |
| 2010/0224516 | A1 * | 9/2010 | Abell | 206/307 |

* cited by examiner

SLIDING PANEL BOX GIFT CARD HOLDER

CROSS REFERENCE TO RELATED APPLICATIONS

This application claims the benefit of the prior filed, provisional application Ser. No. 61/412,305, filed Nov. 10, 2010.

BACKGROUND OF THE INVENTION

This invention relates generally to gift card holders and more particularly to a device for holding a gift card or gift card packet while providing graphical and mechanical enhancements to entertain the gift card recipient and add value to the gift, namely a two leaf sliding panel for holding a gift card, the panel being mounted in a box so that in a first position the panel covers an image or object within the box and in a second position, as drawn upward, reveals the interior of the box, and in a third position, when drawn completely upward, opens to reveal a gift card secured between the leaves.

Transaction cards, stored value cards, or gift cards, as they are commonly called based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or may be selected at the point of sale by the purchaser and loaded by the cashier using a magnetic card reader/writer. While popular, gift cards are typically provided with a generic and impersonal design, typically identifying the associated merchant for which the card may be used to purchase merchandise, and therefore are not personalized in view of the intended recipient.

What is needed, therefore, is a gift card holder that provides graphical and mechanical enhancements to entertain the gift card recipient and add value to the gift, and that causes, in a single fluid motion, both an image (or object) within a box and a gift card to be revealed nearly simultaneously though they are in distal locations on the holder.

BRIEF DESCRIPTION OF THE INVENTION

The purpose of this invention is to provide a holder for receiving and holding a gift card. The gift card holder provides graphical and mechanical enhancements to entertain the gift card recipient and add value to the gift. Pulling the holder panel in a single, fluid motion causes both an image (or object) within a box portion of the holder and a gift card held within the panel to be revealed nearly simultaneously, though they are in distal locations on the holder. The holder comprises a two leaf sliding panel for holding a gift card, the panel being mounted in a box so that while the panel is being drawn out of the box initially, and in a first position, the panel covers an image or object within the box, in a second position as the panel is drawn upward it reveals the interior of the box, and in a third position when the panel is drawn completely upward it opens to reveal a gift card secured between the leaves.

A further embodiment of a sliding panel card holder includes a two-leaf sliding panel slidably mounted within a box, an interior space within the box, and a framed opening in a front side of the box, the opening leading from the exterior of the box to the interior space. In some further embodiments, the framed opening is covered by a transparent film or sheet or other transparent covering. An image is mounted within the interior space and is oriented to face the framed opening. The sliding panel covers the framed opening and obscures the image from view when the panel is in a first, fully closed position within the box. When the panel is partially withdrawn to a partially open second position, the panel no longer substantially covers the framed opening and the interior space and image are revealed. When the panel is yet further withdrawn to a fully open third position, the panel leaves fall away from each other and open to reveal a card held therebetween. Typically, the card is held to one of the leaves via a pocket or corner slits or other means. The card may be a transaction card, such as a gift card. The image may be a two-dimensional graphic, photo or artwork or may be a three-dimensional object.

Other advantages of the invention will become apparent from the following description taken in connection with the accompanying drawings, wherein is set forth by way of illustration and example an embodiment of the present invention.

DETAILED DESCRIPTION

Figure 2:
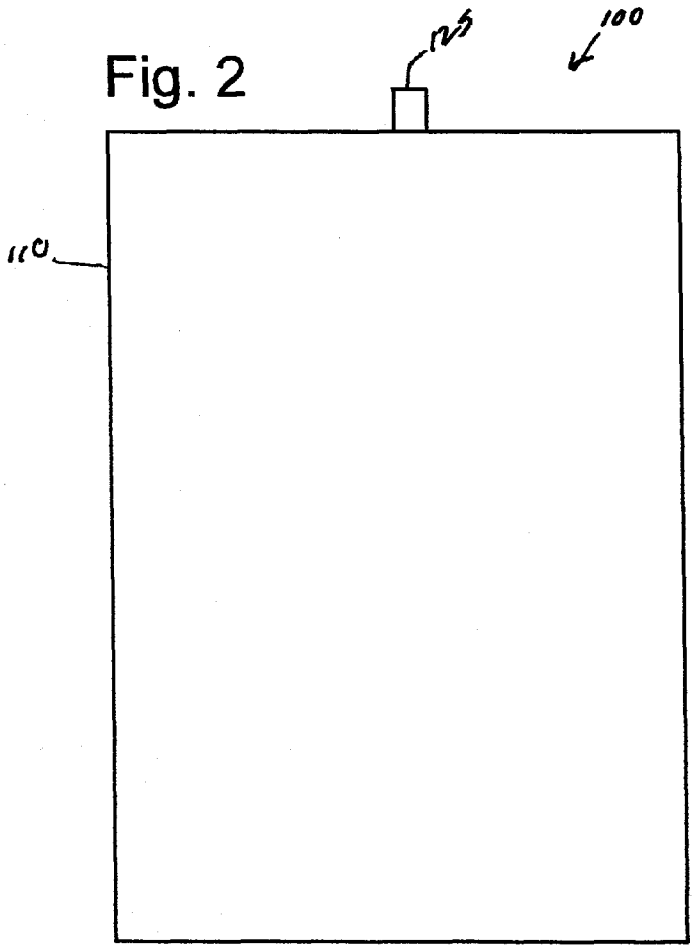
FIG. 2 is a rear view of the gift card holder.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

With reference to the figures, FIGS. 1 through 6 illustrate one or more embodiments of a sliding panel box gift card holder 100. The holder 100 comprises a two leaf sliding panel 105 for holding a gift card (not shown but known in the prior art), the panel 105 being mounted in a box 110 so that, if the fluid motion of the panel 105 being drawn out of the box 110 is paused it may be observed that in a first position the panel 105 covers an image (or object) 115 within the box 110, and in a second position as the panel is drawn further upward it reveals the interior space 120 of the box 110, and in a third position when the panel is drawn completely upward it opens to reveal a gift card secured between the panel leaves 105*a* and 105*b* within a slot or pocket 130.

In use, pulling the holder panel 105 in a single, fluid motion causes both an image 115 within the interior space 120 of the box 110, and a gift card held within the panel 105*b* pocket 130, to be revealed nearly simultaneously, though the gift card and image 115 are in distal locations on the holder 100.

Figure 1:
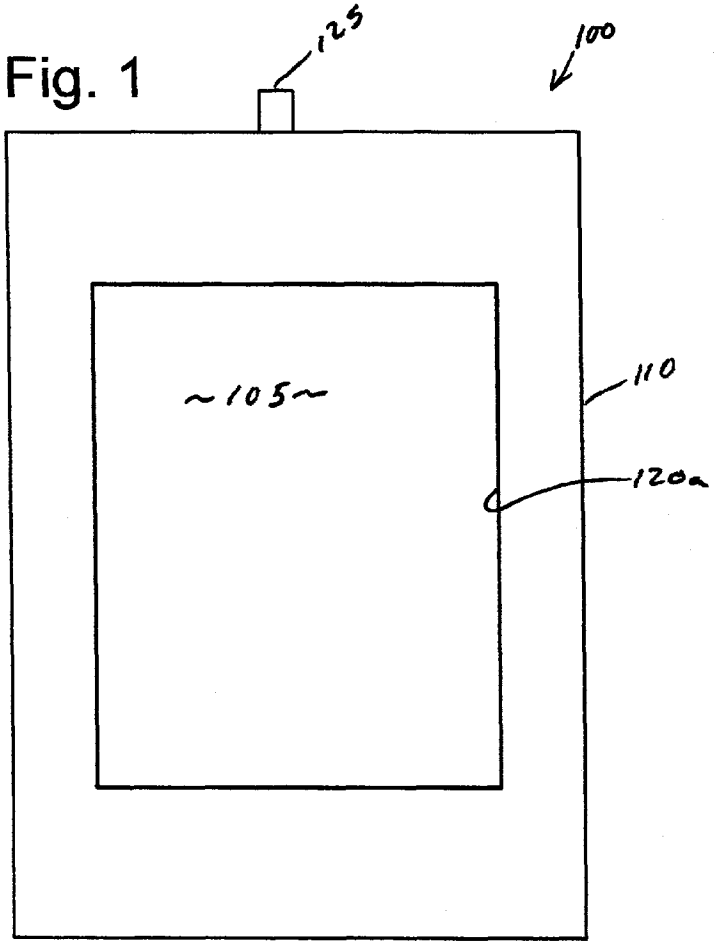
FIG. 1 is a front view of a gift card holder including a box with an interior space and a sliding panel therein shown in a closed position.

FIG. 1 is a front view of a gift card holder 100 including a box 110 with an interior space 120 (shown in other views) and a sliding panel 105 therein shown in a closed position. An aperture or window 120*a* in the front panel 110*a* of the box opens into the interior space 120 but frames the front surface of the front leaf 105*a* when the panel 105 is within the box 110 and the box is closed. FIG. 2 is a rear view of the gift card holder 100. As shown in FIGS. 1 through 5, a ribbon or pull tab 125 is affixed to the top edge of the panel 105, typically the back leaf 105*b*. Since the panel 105 is held fully within the box 110 when the holder 100 is not in use, the pull tab 125 is positioned to extend outward from the box 110 to afford a means of grasping a panel element to pull the panel 105 from the box 100.

Figure 3:
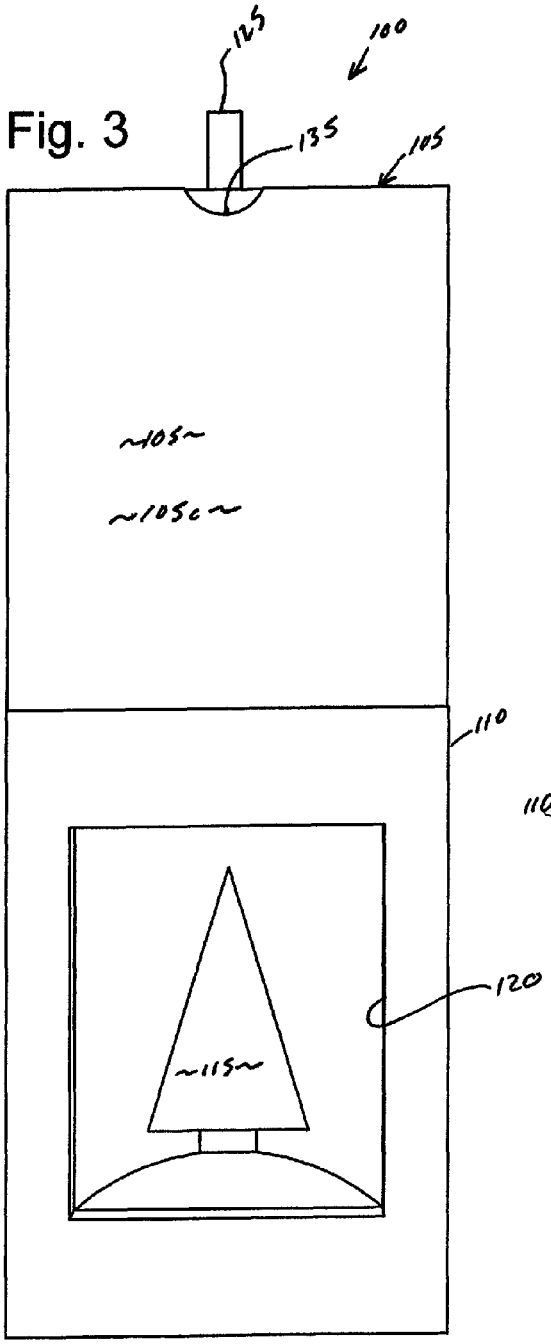
FIG. 3 is a front view of the gift card holder showing the panel in a fully raised position to reveal an object or image held within the interior space of the box.
Figure 4:
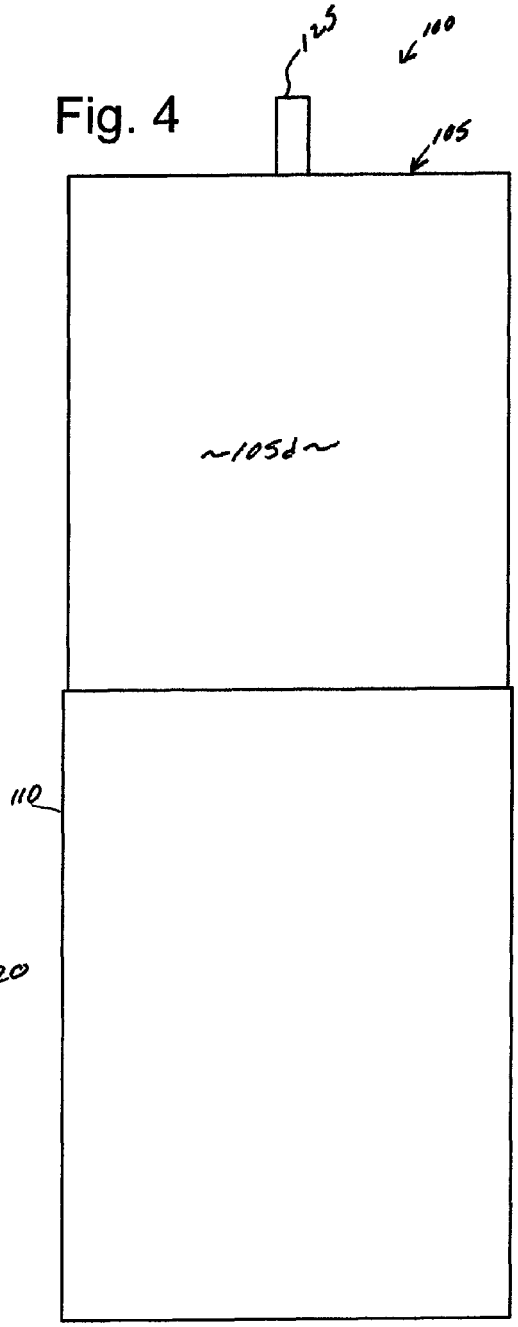
FIG. 4 is a rear view of the gift card holder showing the panel in a fully raised position.

FIG. 3 is a front view of the gift card holder 100 showing the panel 105 in a fully raised position which reveals the image 115 held within the interior space 120 of the box 110. FIG. 4 is a rear view of the gift card holder 100 also showing the panel 105 in a fully raised position. In these views, the panel leaves 105*a* and 105*b* are shown before they have separated and are still adjacent to one another as when inside the box 110.

Figure 5:
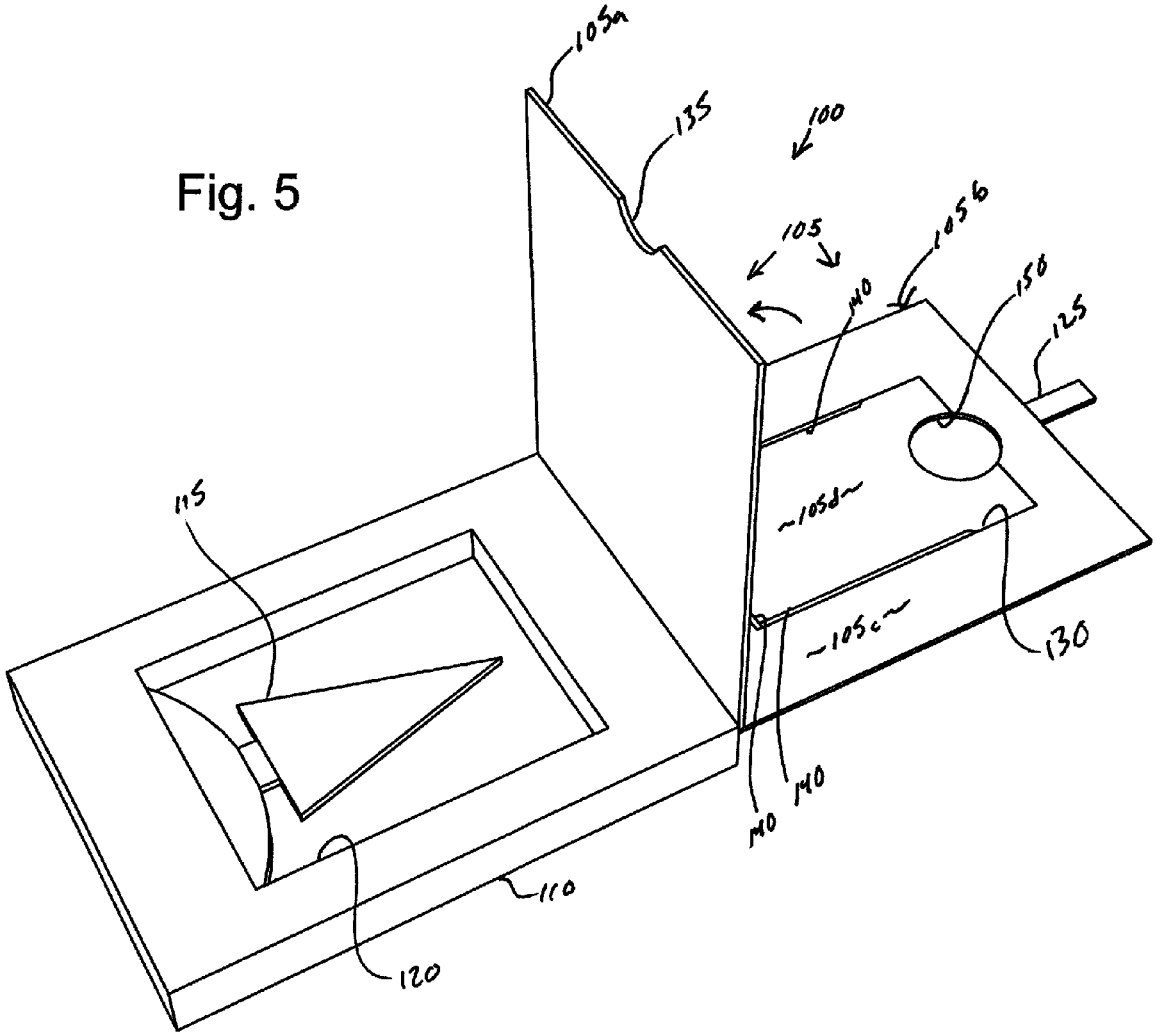
FIG. 5 is a perspective view of the gift card holder showing the panel fully raised and the front panel leaf opened forward to reveal the slot located on the back panel leaf which is used for holding a gift card within the panel and holder.

FIG. 5 is a perspective view of the gift card holder 100 showing the panel 105 fully raised and the front panel leaf 105*a* having fallen forward to reveal the pocket 130 located on the forward surface of the back panel leaf 105*b*. The pocket 130 is used for holding a gift card within the panel 105 and holder 100. A notch 135 in the top surface of the front leaf 105*a* may be provided to receive the user's finger in case the front leaf 105*a* does not fully open upon full withdrawal of the panel 105 from the box 110. In such case, the front leaf 105*a* may be readily opened further by pulling the top edge of the front leaf 105*a* downward.

Whereas the front leaf 105*a* is typically formed of a single thickness of card stock (the entire holder may be constructed of cardstock or other operative materials), the back leaf 105*b* is typically formed of two layers of cardstock with the inner layer 105*c* having a cutout portion concomitant with the pocket 130 margins and a portion of the outer layer 105*d* forming the back wall of the pocket 130. The inner layer 105*c* and outer layer 105*d* are adhered to one another with adhesive or by other means with the exception of a narrow band 140 of layer 105*c* at the bottom and side margins of the pocket 130 which is not adhered to layer 105*d* so that it may form a receiving frame 140 for receiving and retaining edges of a gift card inserted into the pocket 130 between the frame 140 and the outer layer 105*d*. An aperture, in the present example a round hole 150, may be provided in the back leaf 105*b* to assist in removing a gift card from the pocket 130. The hole 150 provides access to the back surface of a gift card held within the pocket 130 so that a user may push against the gift card through the hole 150 to push it past the receiving frame 140 by deflecting the receiving frame elements outward or, alternatively, may use the hole 150 so that the gift card can be gripped on either side and drawn upward from the pocket 130.

Figure 6:
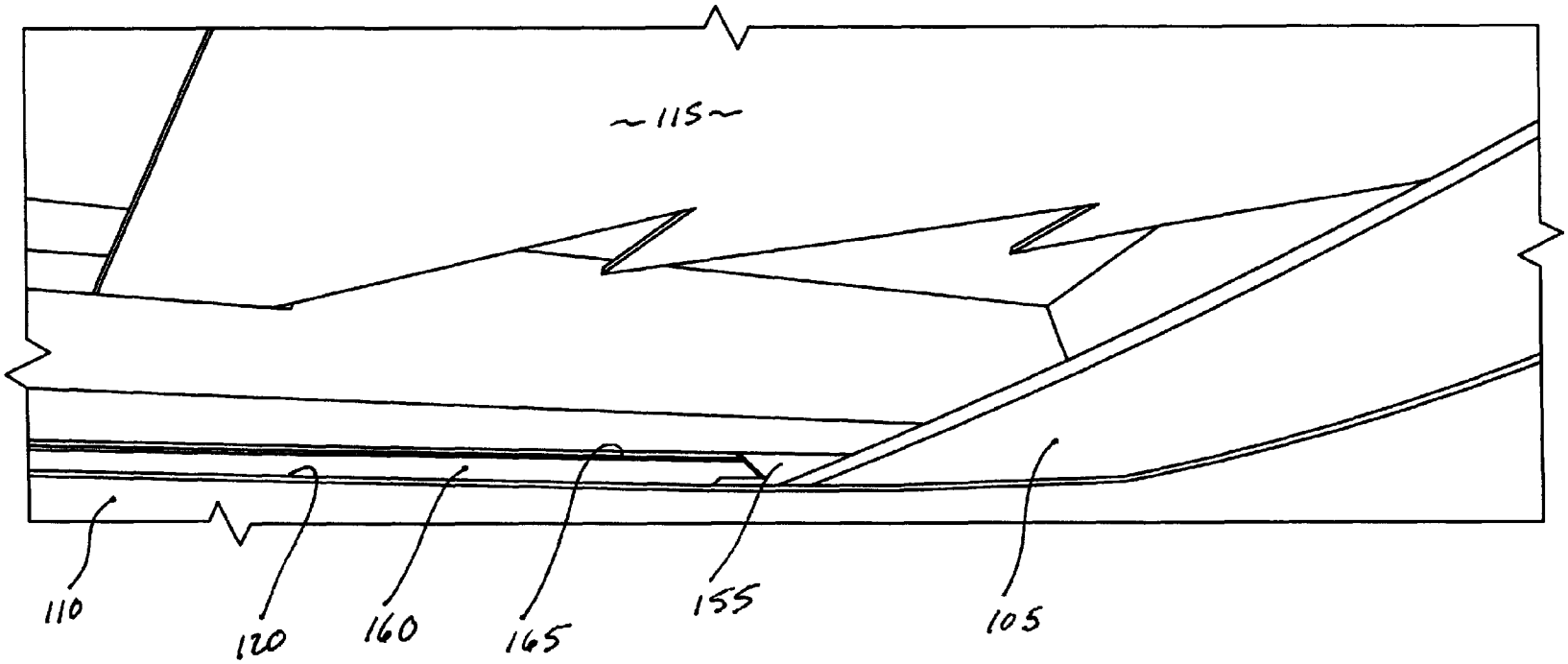
FIG. 6 is an enlarged partial, perspective view of the interior space of the box showing one of two panel tabs engaged with a slot or track within the box.

FIG. 6 is an enlarged partial, perspective view of the interior space 120 of the box 110 showing one of two panel tabs 155 engaged with the a track 160 provided on each side within the box 110. Each panel tab 155 comprises a portion of the outer layer 105*d* of the back leaf 105*b* that is cut partially away from the layer 105*d* and bent back to slide into a slot 165 that forms a part of, and substantially runs the length of, the track 160. The slot 165 terminates prior to reaching the top edge of the box 110 and this termination point abuts the panel tab 155 as the panel 105 is drawn to its most upward and extended position thereby preventing the panel 105 from being fully withdrawn from the box 110. Typically, a track 160 and tab 155 assembly is provided on each side of the holder 100 within the holder interior.

Note that drawings are not to scale or to relative scale but are representative of aspects of one or more embodiments of the present invention.

Having thus described the invention, what is claimed as new and desired to be secured by Letters Patent is:

1. A sliding panel card holder comprising:

a two-leaf sliding panel slidably mounted within a box;

an interior space within said box;

a framed opening in a side of said box, said opening leading from the exterior of said box to said interior space;

a decorative image mounted within said interior space and oriented to face said framed opening, wherein the decorative image is received in one or more channels defined by one or more walls of the box and is fixedly engaged to the one or more walls of the box;

said panel covering said framed opening and obscuring said decorative image from view when said panel is in a fully closed first position;

said panel revealing said interior space when partially withdrawn from said box to a partially open second position;

wherein said two-leaf sliding panel is received in a pair of tracks formed within a sidewall of the box and wherein portions of at least one leaf of the two-leaf sliding panel are rotated away from the sliding panel and positioned within the pair of tracks; and said leaves of said panel hingedly opening to reveal a card held there between when said panel is fully withdrawn from said box to a fully open third position.

2. The holder of claim 1 further comprising a substantially transparent covering over said framed opening.

3. The holder of claim 1 wherein said card comprises a transaction card.

4. The holder of claim 1 wherein said decorative image comprises a three dimensional object.

5. A card holder comprising:

a sliding panel slidably mounted within a box, the sliding panel comprising at least two leaves selectively movable from a closed position adjacent to one another and an open position in which the leaves are separated from one another;

an interior space within the box;

a framed opening in a side of the box, the opening leading from the exterior of the box to the interior space; and a decorative image mounted within the interior space, wherein the decorative image is received in one or more channels defined by one or more walls of the box and is fixedly engaged to the one or more walls of the box;

a pair of tracks formed within a sidewall of the box in which each track engages opposing sides of the sliding panel, wherein opposing portions of at least one leaf of the two leaves preventing the sliding panel from being fully withdrawn from the box;

wherein when the sliding panel is fully inserted in the box in a first position, the panel covers the framed opening and hides the decorative image from view;

wherein when the sliding panel is partially removed from the box in a second position, the sliding panel reveals at least a portion of the interior space;

wherein when the sliding panel is fully extended from the box in a third position, the leaves of the sliding panel are hingedly openable to the open position to reveal a card held between the leaves; and, wherein the leaves are allowed to move to the open position when the sliding panel is moved to the third position.

6. The card holder of claim 5, wherein the decorative image is oriented to face the framed opening.

7. The card holder of claim 5, wherein the card comprises a stored-value card.

8. The card holder of claim 7, wherein the stored-value card comprises a gift card.

9. The sliding panel card holder of claim 1, wherein the at least one leaf of the two-leaf sliding panel defines a recessed pocket to receive the card.

10. The card holder of claim 5, wherein the at least one leaf of the two-leaf sliding panel defines a recessed pocket to receive the card.

11. The sliding panel card holder of claim 10, wherein the at least one leaf of the two-leaf sliding panel has an aperture to assist in removing the card.

* * * * *